United States Patent [19]

Mair et al.

[11] Patent Number: 4,600,505

[45] Date of Patent: Jul. 15, 1986

[54] SINGLE FLOAT STEP PHOSPHATE ORE BENEFICIATION

[75] Inventors: Alexander D. Mair; Myra M. Soroczak, both of Florence, Ala.

[73] Assignee: Tennessee Valley Authority, Muscle Shoals, Ala.

[21] Appl. No.: 773,905

[22] Filed: Sep. 9, 1985

Related U.S. Application Data

[63] Continuation-in-part of Ser. No. 708,914, Mar. 6, 1985, now Defensive Publication No. T106,002.

[51] Int. Cl.[4] ..... B03D 1/02

[52] U.S. Cl. ..... 209/9; 209/166

[58] Field of Search ..... 209/9, 166

[56] References Cited

U.S. PATENT DOCUMENTS

| | | | |
|---|---|---|---|
| 3,309,029 | 3/1967 | Frame | 209/166 |
| 4,362,615 | 12/1982 | Llewellyn | 209/166 |
| 4,514,290 | 4/1985 | Swiatkowski et al. | 209/166 |

*Primary Examiner*—Bernard Nozick

*Attorney, Agent, or Firm*—Robert A. Petrusek

[57] ABSTRACT

A flotation process is taught for beneficiating phosphate ores containing, as impurities, silica and alkaline earth metal carbonates, particularly dolomite. Using a single flotation stage, the phosphate values are recovered in the overflow and quite unexpectedly both the siliceous and the carbonate gangue minerals are simultaneously removed in the underflow. Prior to flotation, surfaces of the minerals in the phosphate ore are selectively sulfidized with an insoluble copper-containing metal sulfide, permitting use of sulfide mineral collecting reagents such as alkyl xanthates in the flotation step to achieve a high degree of selectivity.

21 Claims, No Drawings

SINGLE FLOAT STEP PHOSPHATE ORE BENEFICIATION

The invention herein described may be manufactured and used by and for the Government for governmental purposes without the payment to us of any royalty therefor.

This application is a continuation-in-part of application Ser. No. 708,914, filed Mar. 6, 1985 now T106002.

INTRODUCTION

The present invention relates to the beneficiation of phosphate ores and more particularly, the present invention relates to a process for beneficiating phosphate ores containing siliceous and alkaline earth metal carbonate impurities.

BACKGROUND OF THE INVENTION

1. Field of the Invention

For the past forty years the normal procedure for beneficiating Florida phosphate rock from associated gangue minerals has included a double flotation (or Crago flotation) step for that portion of the mineral feed in the size range of approximately 0.1–1 mm, which portion generally contains an appreciable fraction of the phosphate values. In this flotation process, which removes the major contaminant (quartz sand), the deslimed feed rock is first subjected to flotation using a mixture of fatty acids and fuel oil as collector. The resultant overflow, known as rougher concentrate, retains most of the phosphate mineral and some entrained quartz. After deoiling, this rougher concentrate is subjected to a reverse flotation step using cationic collectors such as primary amines, which floats off most of the remaining quartz and retains a high-grade phosphate concentrate in the underflow. Since its introduction, this flotation procedure, as described by A. Crago (U.S. Pat. No. 2,293,640), has been successfully employed for siliceous central Florida phosphate deposits with little subsequent process modification.

However, the ore of the Florida Bone Valley Formation most suited to this beneficiation procedure is rapidly being depleted. Lower quality ore from the southern extension of the central Florida phosphate field is now of necessity becoming commercially exploited. This lower quality ore from the Hawthorn Formation is somewhat mineralogically different from that of the Bone Valley Formation. The Hawthorn ore is generally less weathered or altered and usually contains appreciable quantities of alkaline earth metal carbonate minerals such as dolomite. Surface chemical properties of carbonate minerals such as dolomite, calcite, or dolomitic limestone are often very similar to the surface chemical properties of the predominant phosphate mineral in the ore, a sedimentary marine carbonate-apatite known as francolite. For instance, the generally recognized similarity in response of calcite, dolomite, and francolite minerals to fatty-acid flotation collectors is believed largely due to specific adsorption and bonding of the fatty acid to the mineral surface by salt-like complexing of the fatty-acid carboxyl moiety with the surface calcium ions common to all these minerals. Because of these surface similarities, it is difficult to separate carbonates from the phosphate minerals by physical beneficiation methods such as flotation, which are dependent for their success on exploiting dissimilarities in the surface properties of the minerals to be separated. Hence, the Crago double-float process has, unfortunately, been ineffectual in separating carbonate gangue from the phosphaate values.

The presence of carbonate in the phosphate concentrate is undesirable; it not only acts as a $P_2O_5$ diluent, but also is detrimental in subsequent chemical processing of the rock. In phosphoric acid or superphosphate manufacture, for example, the presence of carbonates consumes additional sulfuric acid in the acidulation steps without providing additional fertilizer values. Carbonate also exacerbates foam formation in the reactor vessels thereby reducing their effective production capacity. The presence of appreciable MgO in the phosphate concentrate (e.g., $MgO > 1\%$), as derived from dolomite or dolomitic limestone, is particularly objectionable in the manufacture of wet-process phosphoric acid (hereinafter referred to for the sake of convenience simply as WPA) since a significant MgO content in the resulting product WPA causes deposits of sludges and scale during and after processing of the rock concentrate to phosphoric acid. Because of this inability of the Crago double-float process to separate gangue minerals other than silica, for example, carbonates such as dolomite and calcite, from the phosphate concentrate, and since the supply of high quality phosphate ore is being depleted, there is a most pressing need for a flotation process suitable for Florida and similar phosphate rocks whereby both the siliceous and carbonate impurities therein can be separated effectively from the phosphate values.

2. Description of the Prior Art

The prior art teaches that numerous attempts have been made to develop processes for separating carbonate minerals such as dolomite from the phosphate mineral contained in Florida-like phosphatic ores where silica is the principal impurity. In all the prior art where particle size of the rock feed permits effective separation by flotation, siliceous materials, such as quartz sand, and alkaline earth metal carbonates, such as dolomite, are removed in separate flotation steps. The silica is removed using one or both stages of the Crago double-float method. The carbonate is subsequently or sometimes previously removed from the phosphate values in another separate and distinct flotation stage, often requiring a different collector reagent and, in all instances, use of a flotation depressant for either phosphate or carbonate.

For example, in U.S. Pat. No. 4,287,053 (assigned to the assignee of the instant invention), J. R. Lehr et al teach that dolomite is removed from the phosphate mineral by floating off the dolomite using fatty-acid collectors while depressing the phosphate mineral flotation by addition of organic phosphonic acids. In another such related teaching, R. E. Snow in U.S. Pat. No. 4,364,824 discloses that dolomite is floated off using sulfonated fatty-acid collectors while the phosphate mineral flotation is suppressed by addition of depressants such as sodium tripolyphosphate. Conversely, in U.S. Pat. No. 4,144,969, R. E. Snow teaches that the phosphate mineral is preferentially floated using primary amine collectors, while dolomite is removed in the underflow using fluoride as a depressant.

All such beneficiation schemes supra are complex, with the severe disadvantage that maintenance of two or usually three separate and distinct flotation circuits are necessary to ensure removal of both siliceous and dolomitic impurities. An attendant problem exists in that each flotation stage generally requires a separate conditioning step and often an additional processing step to remove reagents used in the previous flotation stage from the mineral surfaces prior to the next flotation stage. None of these processes have proven entirely successful and, as yet, no completely satisfactory beneficiation scheme exists for dolomitic phosphate ores of the Florida type.

Thus it is apparent that it is becoming increasingly desirable that there be developed or devised an improved method for beneficiating these ores, preferably by a more economical and technically less complex process requiring fewer flotation stages to remove both carbonate, particularly dolomite, and siliceous impurities from the phosphate ore.

SUMMARY OF THE INVENTION

Our new and unexpected discovery comprising the instant invention provides such a process wherein the surface properties of the ore are selectively and substantially modified in a novel manner by selectively coating the phosphate mineral surfaces with a molecular layer of metal sulfide. The procedure of the instant invention renders the phosphate mineral responsive to sulfide flotation collector reagents, permitting subsequent separation of the phosphate mineral directly from both the siliceous and the alkaline earth metal carbonate impurities simultaneously in but a single flotation step.

In addition to decreasing the number of flotation circuits required by previously proposed schemes for separating the phosphate values from siliceous and carbonate gangue, our new and novel invention has the further distinct advantage of eliminating the use of reagents derived from tall oil in the flotation circuit. Tall oil is the main source of fatty acids required in the Crago flotation process and modifications thereof. However, the increasing scarcity, variable composition, and increasing cost of tall oil in recent years has made the use of alternatives therefor as flotation reagents in phosphate beneficiation increasingly attractive.

According to the teachings of the present invention, the simultaneous removal of both siliceous and alkaline earth metal carbonate gangue from the phosphate values in a Florida or similar phosphate ore is provided by a single-stage flotation process. Prior to the flotation step, a deslimed flotation feed prepared from the raw ore is subjected to a sulfidization treatment whereby the surfaces of the phosphate minerals are selectively sulfidized with insoluble metal sulfides containing copper as a major constituent. This procedure provides recovery of the phosphate values in the overflow during subsequent froth flotation with sulfide mineral collector reagents and removal of both siliceous and alkaline earth metal carbonate impurities in the underflow.

OBJECTS OF THE INVENTION

It is therefore a principal object of the present invention to provide an improved process for removing both siliceous and alkaline earth metal carbonate impurities from phosphate ores.

It is a further object of the present invention to provide a process whereby major impurities in dolomitic Florida and similar phosphate ores, namely quartz sand and dolomite, can simultaneously be separated efficiently and economically from the phosphate values by a one-stage flotation process.

Another object of the present invention is to provide a process to recover a phosphate concentrate from dolomitic Florida and similar phosphate ores whereupon acidulation of said phosphate concentrate to phosphoric acid by the wet process will produce a high-quality acid having a soluble MgO content sufficiently low to be acceptable to commercial processors and users of phosphate acid and products associated therewith.

Still further and more general objects and advantages of the present invention will appear from the more detailed description set forth below, it being understood, however, that this more detailed description is given by way of illustration and explanation only and not necessarily by way of limitation since various changes therein may be made by those skilled in the art without departing from the scope and true spirit of the present invention.

DESCRIPTION OF THE PREFERRED EMBODIMENTS

In the preferred embodiment of the present invention, a sized and deslimed phosphate ore flotation feed containing alkaline earth metal carbonate and siliceous gangue is first subjected to a treatment whereby the surfaces of the phosphate mineral are selectively sulfidized with an insoluble metal sulfide containing copper as a major constituent. After washing off any excess of the nonadsorbed species used in the sulfidization treatment, the flotation feed is conditioned with a solution containing a collector capable of floating sulfide minerals, such as, for example, an alkyl xanthate. In the subsequent single froth flotation step, the phosphate mineral is floated and removed in the froth as a finished concentrate product while carbonate and siliceous gangue minerals remain in the underflow.

For the sulfidization treatment prior to froth flotation, the sulfide source material may be gaseous, liquid, or solid in nature. The source material is most conveniently supplied as, but not necessarily limited to, a water-soluble alkali sulfide, as represented by the sulfides or hydrosulfides of sodium, potassium, or ammonium.

With regard to the metal source providing the necessary insoluble sulfide coating, we have discovered that a copper species is the preferred metal entity in the practice of our invention for high selectivity in forming a molecular layer of insoluble sulfide on the surfaces of the phosphate mineral. This procedure renders the phosphate mineral responsive to sulfide flotation collector reagents and provides good separation of phosphate minerals from the gangue minerals during flotation. Although the reasons are not yet known why the presence of copper in the sulfide surface coatings is desirable in the practice of our invention, we also have discovered that heavy metals such as zinc, while ineffective when used alone, may partially replace copper with no apparent significant loss of effectiveness or selectivity. We also have tentatively found that use of yet other heavy metals such as iron in the sulfidization step appear to have little or no influence on the mineral separation by flotation when either used alone or to partially replace copper.

During other experimental work leading to the discoveries of the present invention, it was found that use of pure sulfides in the sulfidization treatment gave poor recovery of the phosphate mineral in the overflow of the subsequent froth flotation step. Use of slightly impure sulfide gave a dramatic improvement in recovery of the phosphate mineral, as did controlled additions of thiosulfate to the pure sulfide prior to the sulfidization treatment. Entire replacement of the sulfide by reagents containing sulfur in a more highly oxidized state, such as thiosulfate, may even be possible or desirable. Although the mechanisms of the process of the invention are not yet well understood, as a result of these findings, it is believed that some oxidation of the sulfide used in the present invention, as provided by the presence of partially oxidized sulfide species such as polysulfides, elemental sulfur, thiosulfate, polythionates, and sulfites, is beneficial and perhaps necessary for successful recovery and separation of the phosphate mineral from the carbonate and siliceous gangue. Other experimental work leading to the present invention also indicates that oxidizing conditions are necessary during the froth flotation step when employing a reagent such as an alkyl xanthate as the phosphate collector. Thus, employment of air as the gaseous flotation agent was found to give a good float of phosphate mineral, whereas corresponding use of pure nitrogen gave no mineral float whatsoever, unless an oxidant such as hydrogen peroxide was also present.

The flotation collector used to recover the phosphate mineral may comprise one or more compounds which may include, but are not limited to, those classes of organic sulfur compounds known to those skilled in the art as suitable for use in sulfide mineral flotation technology. Such compounds include the following representative classes and their derivatives: thiocarbonates including xanthates, dithiophosphates, thiocarbamates, thionocarbamate esters, and mercaptans.

In one embodiment of the present invention a two-step sulfidization treatment of the flotation feed preceding the collector conditioning and flotation steps provides for initial immersion of the feed rock in an aqueous solution of a soluble salt of copper, with copper preferentially adsorbing on the phosphate mineral surfaces as a mordant. In a subsequent and separate sulfidization treatment, the adsorbed copper ions react with soluble sulfide to form in situ a molecular layer of highly insoluble copper sulfide on the phosphate mineral surfaces, too thin to be observed directly, but detectable or verifiable by energy-dispersive X-ray surface analysis. Soluble salts of other cations may supplement or partially replace the soluble copper salt in the metal adsorption step, with formation of sulfide coatings containing both copper and other adsorbed cations. After separation of the treated feed rock from the solution containing the soluble metal ions, the feed then is treated with the sulfidizing reagent which may be gaseous or liquid, but is preferentially an aqueous solution of a soluble sulfide.

In another embodiment of the present invention, a one-step sulfidization treatment of the phosphate flotation feed preceding the collector conditioning and flotation steps provides for the immersion of the phosphate flotation feed in an aqueous dispersion of a copper-containing sulfide in the form of a colloidal suspension, with preferential adsorption of the sulfide colloid onto the surface of the phosphate mineral.

Alternatively, the phosphate flotation feed rock may be immersed in an aqueous solution containing copper and sulfide ions, with the sulfidization treatment taking place before significant nucleation and precipitation of the copper containing sulfide colloid occurs in the bulk solution phase.

In still another embodiment of the present invention, the sulfidization treatment of the phosphate flotation feed as specified in one of the prior embodiments supra is followed by a conditioning treatment in which a sulfide mineral flotation collector, such as an alkyl xanthate, is supplemented or replaced by one or more collectors which are normally not used in current sulfide mineral flotation technology. Such supplementary or substitute collectors may be surface-active reagents not commonly considered by those skilled in the art as viable sulfide mineral collectors used in present day sulfide mineral flotation technology. Included in this category are those collectors commonly used in nonsulfide mineral flotation, such as organic sulfonates, organic sulfates, fatty acids, sulfonated fatty acids, and tall oils.

Despite the advantages claimed above for our new process whereby use of tall oils can now be partially or totally eliminated from phosphate flotation processing, there may be some instances or circumstances wherein employment of tall oil as a supplementary or at least partial substitute collector can be advantageous. Such instances include, but, of course, are not limited to, circumstances wherein considerable amounts of tall oil have hitherto been used in phosphate flotation, as in the Crago process, and which on discontinuing use of such process leads to outstanding, but now apparently unnecessary, contracts for tall oil delivery and to excessive inventories of tall oils; and also circumstances caused by geographic location wherein tall oils may be locally available in abundant and relatively cheap supply.

Those skilled in the art will appreciate that the process of the present invention is not to be construed to be restricted to the use of phosphate ores from Florida, but also will be beneficial when utilized on phosphate ores from other deposits, particularly those containing undesirable levels of siliceous and alkaline earth metal carbonate impurities. Other such phosphate ores suitable for employment of the method of the present invention include, but are not limited to, those from the Pungo River Formation as found in North Carolina and those from the Phosphoria Formation of the Western United States.

Phosphate ores from Florida and from other deposits which are suitable for beneficiation by practice of the process of the present invention may occur naturally in discreet particles, or if not, may be comminuted and classified to desired size ranges by methods known to those skilled in the art. Inasmuch as an appreciable amount of the gangue minerals may remain locked within the larger size phosphate particles and since these larger ore particles are often difficult to float, a feed particle size smaller than 600 mm is preferably used for practice of the process of the instant invention. Very small particles, e.g., smaller than about 35–100 mm, are removed by a scrubbing and desliming pretreatment of the raw ore prior to the sulfurization step. The slime fraction generally contains a considerable proportion of clays and carbonate impurities and some phosphate values. However, it is generally recognized in commercial processing that the relatively high consumption of process reagents by slimes and the high ratio of impurity to phosphate values in the slime make recovery of phosphate values from this fraction economically unattractive.

Although the present invention as herein described has proven successful in the beneficiation of the dolomitic Florida phosphate ores tested, it will be understood by those skilled in the art that in application of the invention on a commercial scale and also in application to other phosphate ores, even those appearing superficially to be mineralogically identical or only slightly different from those ores tested, changes in process conditions or modification of the process of the instant invention may be beneficial or necessary.

EXAMPLES

In order that those skilled in the art may better understand how the present invention can be practiced and more fully and definitely understood, the following examples are given by way of illustration and not necessarily by way of limitation since various changes therein may be made by those skilled in the act without departing from the true spirit and scope of the present invention.

For the sake of convenience, all mesh sizes herein referred to are, unless identified to the contrary, of the Tyler series.

EXAMPLE I

For the purposes of investigations reflected by this example, a phosphate ore was selected from the southern extension of the central Forida deposit, said phosphate ore containing dolomite and quartz minerals as the major impurities. Typically, such ore assays as follows: 5 percent to 22 percent $P_2O_5$, 1 percent to 6 percent MgO, and 45 percent to 75 percent $SiO_2$. The particular ore used in this series of tests assayed 8.5 percent $P_2O_5$, 4 percent MgO, and 56 percent $SiO_2$. The portion of the ore retained by a one-fourth-inch mesh screen was carfully crushed and ground, screened into fractions of different size ranges, and deslimed by washing on an appropriate screen. The ore fraction with particle diameters of 212–300 μm (−48 +65 mesh) was chosen for use in this example. To further remove fines and clays adsorbed on the mineral surfaces, this fraction was scrubbed with water for two minutes and washed with water on a 65-mesh screen. After such treatment this fraction of the ore contained approximately 21 percent as the phosphate mineral (apatite), 8 percent as dolomite, and 71 percent as quartz. Tests on this ore fraction then were made using all sequential steps of the following procedure or with some of the steps omitted as indicated infra.

Step 1: Treatment of the ore with a copper nitrate solution to selectively adsorb cupric ions on the mineral surfaces by adding about 1.5 g of the phosphate ore to 125 ml of an aqueous solution of 0.1M $Cu(NO_3)_2$ preadjusted with dilute nitric acid to a pH of 4.0, treating the ore with this solution for a period of 15 minutes, and subsequently decanting the treatment solution from the ore.

Step 2: Treatment with a sulfidization agent by immersion of the ore for about two minutes in 140 ml of an aqueous solution of 0.0002M sodium sulfide with the pH thereof preadjusted to 8.0 with dilute nitric acid, followed by rinsing of the ore with 100 ml of water.

Step 3: Transfer of the ore to a small glass flotation cell of classical design to condition the ore with a typical sulfide flotation collector reagent, in this instance the potassium salt of ethyl xanthate, by treating the ore for about three minutes in the flotation cell with 115 ml of an aqueous 0.001M potassium ethyl xanthate solution, with the pH thereof preadjusted with dilute $HNO_3$ or $NH_4OH$ to a value of 8.5 if necessary.

Step 4: After conditioning, the ore was subjected to the process of froth flotation whereby air bubbles were passed through the mixture of ore and solution contained in the flotation cell supra for about three minutes at a rate of 50 ml of air per minute. On completion of flotation, the float and sink portions of the ore then were removed, filtered, oven dried, and analyzed.

The procedures for the tests, including one where all the above treatment steps were included, and others (negative examples) wherein one or more steps were modified or omitted, are summarized in Table I below. Also in Table I infra are the resultant percentage of the ore thus floated and, where appropriate, the approximate composition of the floated fraction.

TABLE I

| | Beneficiation Procedures for Example I | | | | | |
|---|---|---|---|---|---|---|
| | Step No. | | | | | |
| Test | 1 | 2 | 3 | 4 | Float, wt % | |
| No. | Cu adsorption | sulfidization | conditioning | flotation | Amount | Composition |
| 1 | Omit | Omit | Omit | Yes[a] | 0 | — |
| 2 | Omit | Omit | Yes | Yes | 2.6 | Dolomite fines only |
| 3 | Omit[b] | Yes | Yes | Yes | 0 | — |
| 4 | Omit | Yes | Yes | Yes | 1.7 | Domolite fines plus little apatite |
| 5 | Yes | Yes | Omit | Yes[a] | 0 | — |
| 6 | Yes | Omit | Yes | Yes | 0 | — |
| 7 | Yes | Yes | Yes | Yes | 16.5 | 94% apatite 1% dolomite 5% quartz |

[a]No xanthate
[b]Cu omitted, weak $HNO_3$ only, pH 4.0.

Referring now more specifically to Table I supra, there are shown the results of one positive combination and six negative combinations, i.e., in only one test (No. 7), which included all steps of the given procedure and represented a particular and important embodiment of our invention, was apatite effectively separated from both dolomite and silica gangue, with a relatively high recovery of the phosphate values (63%) in the float fraction. Of the gangue minerals in test No. 7, 98 percent of the dolomite and 99 percent of the quartz remained unfloated in the sink fraction, demonstrating the good selectivity obtained in this test. Of the other tests where one or more steps in the procedure were omitted, a negligible mineral float occurred with no such selectivity as shown in test No. 7.

The results of these tests demonstrate that inclusion of all steps in the procedure given, as in test No. 7, is necessary for successful separation of the phosphate mineral, apatite, from both the dolomite and quartz gangue in a single flotation step, according to the teachings of our invention. In addition, the results also demonstrate the selectivity of the metal adsorption and sulfidization for the apatite mineral and the responsiveness of the sulfidized apatite to typical sulfide collector reagents such as xanthates. Furthermore, these test results are consistent with the hypothesis that the agent responsible for the success of the mineral separation, as demonstrated in test No. 7, is, indeed, a molecular coating of copper sulfide selectively deposited on the surface of the apatite mineral, which is rendered hydrophobic and thus more readily floatable by interaction of the copper sulfide surface layer with a subsequently adsorbed sulfide flotation collector such as potassium ethyl xanthate. In contrast, no appreciable coating of copper sulfide apparently forms on the dolomite and quartz minerals; the surfaces of these gangue minerals remain hydrophilic, and both dolomite and quartz remain unfloated in the sink fraction.

EXAMPLE II

In the pursuit of further information for the purposes of more clearly defining the parameters affecting the practice of the instant invention, tests were made using the same ore and the complete procedure outlined in Example I supra, with the exception that the metal content and concentration in Step 1, Example I, supra were varied. Another exception concerned conditioning in Step 3 supra—another typical sulfide collector, potassium amyl xanthate, was used at a concentration of 0.16 gram/liter with a conditioning time of about three minutes. The nature of the metal salt solution used in Step 1 supra of the treatment for these tests and corresponding flotation results are given in Table II below.

TABLE II

| Test No. | Step 1 (salt solution) | Flotation Results for Example II: Float | | | | | | |
|---|---|---|---|---|---|---|---|---|
| | | | Composition, wt % | | | Recovery, wt % | | |
| | | Wt % | Apatite | Dolomite | Quartz | Apatite | Dolomite | Quartz |
| 1 | 0.1 M $ZnSO_4$ | <1 | — | — | — | — | — | — |
| 2 | 0.1 M $CuSO_4$ | 18.0 | 92.5 | 1.1 | 6.4 | 75 | 4 | 1.1 |
| 3 | 0.05 M $CuSO_4$ | 12.8 | 91.3 | 2.6 | 6.2 | 65 | 2 | 1.7 |
| 4 | 0.05 M $CuSO_4$ + 0.05 M $ZnSO_4$ | 22.2 | 89.0 | 2.9 | 8.2 | 90 | 8 | 2.6 |

Referring now more specifically to Table II supra, it can be appreciated that the metal cation pretreatment solution of test No. 4 thereof using a mixture of 0.05M $CuSO_4$ and 0.05M $ZnSO_4$ provided a good separation and recovery on flotation of apatite mineral from both dolomite and quartz gangue, with recovery slightly higher and concentrate grade slightly lower than test No. 2 using 0.1M $CuSO_4$ and recovery significantly higher than test No. 3, where 0.05M $CuSO_4$ alone was used in the cation pretreatment solution. Using zinc as this example gives rise to data that clearly demonstrates that in some instances ions of other heavy metals which form highly insoluble and floatable sulfides and which may be available as less costly reagents, advantageously may partially replace the soluble copper species used in the metal adsorption step. However, as demonstrated in test No. 1, zinc salts alone, without the benefit of activation by copper ions, are ineffective in obtaining the objects normally desired and pursued in practice of the process of the instant invention. The results of tests comprising this example further demonstrate the principles of (1) selective metal adsorption by the apatite mineral, (2) sulfidization in situ to form sulfide surface films, and (3) responsiveness of the sulfidized apatite to typical sulfide collector reagents.

EXAMPLE III

The series of tests comprising this example represent an initial scaleup of our invention based on the results of our small-scale experiments taught in Examples I and II supra as well as other herein unreported tests. A phosphate ore from the southern extension of the central Florida deposit containing dolomite was used. It assayed 8.5 percent $P_2O_5$, 4.0 percent MgO, 56 percent $SiO_2$, 0.6 percent $Fe_2O_3$, and 1.3 percent $Al_2O_3$ with the pebble fraction (+28 mesh) being crushed and recombined with the smaller size fraction prior to wet screening of the ore to −28+150 mesh (;b 0.1–0.6 mm) in size and storing it in a moist condition. A 260-gram (dry basis) sample of this prepared ore was subsequently deslimed by scrubbing with water for five minutes at a pulp density of 28 percent solids by weight and then wet screening on a 150-mesh screen. This desliming procedure yielded 217 grams of flotation feed material, which analyzed as 9.5 percent $P_2O_5$, 1.8 percent MgO, and 63 percent $SiO_2$. This feed rock was contacted for 15 minutes with 1.8 liters of an aqueous solution containing 0.05M $CuSO_4$ and 0.05M $ZnSO_4$ at a pH adjusted to 4.0 with 0.1N $HNO_3$. After decanting this solution, the flotation feed then was treated for about two minutes with a sulfidizing solution consisting of 1.8 liters of an aqueous 0.0002M sodium sulfide solution with the pH thereof adjusted to 5.0 with 0.1N $HNO_3$.

In the next step, after decanting the sulfide solution and briefly washing the feed material with 400 ml water, the treated solids were conditioned for some three minutes with a sufficient volume of a potassium amyl xanthate collector solution (0.16 gram/liter of solution with the pH thereof adjusted to 8.5) to provide a slurry volume of 1.2 liters. During conditioning, the slurry pH was maintained at 8.5 with addition of 0.1N $HNO_3$ as required. After conditioning, the slurry (with pulp density 17% solids by weight) was transferred to a Denver laboratory flotation cell, made up to 1.5 liters with additional xanthate solution, and floated with air to recover the phosphate values, leaving both carbonate and silica impurities in the sink. No supplemental frothing reagent was added for the flotation step. The float and sink fractions were filtered, oven dried, and analyzed. Results after one minute of flotation time are shown in Table III below.

TABLE III

| Product | Wt % | Flotation Material Balance: Composition, wt % | | | Distribution, wt % | | |
|---|---|---|---|---|---|---|---|
| | | $P_2O_5$ | MgO | $SiO_2$ | $P_2O_5$ | MgO | $SiO_2$ |
| Float | 5.7 | 31.6 | 0.8 | 7.3 | 18.9 | 2.5 | 0.7 |
| Sink | 94.3 | 8.2 | 1.9 | 66.8 | 81.1 | 97.5 | 99.3 |

TABLE III-continued

| Product | Wt % | Flotation Material Balance Composition, wt % $P_2O_5$ | MgO | $SiO_2$ | Distribution, wt % $P_2O_5$ | MgO | $SiO_2$ |
|---|---|---|---|---|---|---|---|
| Feed | 100.0 | 9.5 | 1.8 | 63.4 | 100.0 | 100.0 | 100.0 |

From an examination of the tabular data just supra it can be seen that herein has been demonstrated the excellent selectivity of the one-step flotation process of our invention, even with the wider particle size distribution of the ore used in this scaled-up test. Although phosphate recovery was low, the grade of the floated phosphate material was high, with good rejection of both dolomite and silica gangue from the float. Quality of the recovered phosphate values in the overflow was comparable to that achieved from similar ores in the more complex flotation schemes of the prior art. Of the small proportion of MgO and $SiO_2$ remaining in the float, much can be accounted for by entrapment or occlusion within the phosphate particles, either as physically embedded dolomite, quartz, or clay particles, or as a chemically bound constituent within the crystal lattice of the apatitic phosphate mineral. Microscopic analysis confirmed that very few discrete free particles of either dolomite or quartz sand were entrained in the phosphate float and thus recovered in the overflow.

EXAMPLE IV

In the conduct of tests comprising the example described herein, the beneficiation procedure of Example III supra using a ore with the same assay was followed, with the exception that the sulfidization treatment was modified. These modifications included increasing the amount of sodium sulfide by using 1000 ml of 0.0028M sodium sulfide solution with the pH thereof preadjusted to 8.0 and increasing the number of 400-ml water rinses after sulfidization to four. The 250-gram ore sample used provided 213 grams of flotation feed material after desliming and analyzed as 9.3 percent $P_2O_5$, 1.7 percent MgO, and 62.5 percent $SiO_2$. Flotation results after 30 seconds of flotation time are presented in Table IV below.

TABLE IV

| Product | Wt % | Flotation Material Balance Composition, wt % $P_2O_5$ | MgO | $SiO_2$ | Distribution, wt % $P_2O_5$ | MgO | $SiO_2$ |
|---|---|---|---|---|---|---|---|
| Float | 20.1 | 28.4 | 0.9 | 8.6 | 61.4 | 10.6 | 2.8 |
| Sink | 79.9 | 4.5 | 1.9 | 76.0 | 38.6 | 89.4 | 97.2 |
| Feed | 100.0 | 9.3 | 1.7 | 62.5 | 100.0 | 100.0 | 100.0 |

From a comparison of the data tabulated in the penultimate table as well as in the table just supra, i.e., Tables III and IV respectively, it can be appreciated that although the grade of the phosphate concentrate was slightly lower than that achieved in Example III supra, recovery of the phosphate values in the tests of this example was substantially increased. We believe that this increase arises primarily from the more than sevenfold increase in total sodium sulfide dosage in the sulfidization step, compared with that amount used in Example III supra. It also appears that increasing the pH of the sulfidization solution from 5, as in Example III supra, to 8, as in the present example, beneficially and desirably decreased emanations of gaseous sulfides from this treatment solution.

EXAMPLE V

For the series of tests carried out and reported herein the beneficiation procedure of Example IV supra using a similar phosphate ore was followed, with the exception that the sodium sulfide concentration used in the sulfidization step was halved although the total amount of sodium sulfide used remained approximately the same, i.e., 1.8 liters of 0.0014M sodium sulfide solution. After desliming, a 250-gram ore sample provided 226 grams of flotation feed material for this example, which analyzed 8.6 percent $P_2O_5$, 1.4 percent MgO, and 67 percent $SiO_2$. Results are reported in Table V below for flotation fractions collected after 15 seconds and 30 seconds total flotation time and also after 3.75 minutes, carrying flotation to the point where no significant amount of material was being transferred to the overflow.

TABLE V

| Product | Flotation time, minutes | Wt % | Flotation Material Balance Composition, wt % $P_2O_5$ | MgO | $SiO_2$ | Distribution, wt % $P_2O_5$ | MgO | $SiO_2$ |
|---|---|---|---|---|---|---|---|---|
| Float 1 | 0.25 | 18.4 | 27.7 | 1.0 | 10.7 | 59.1 | 13.1 | 2.9 |
| Float 2 | 0.5 | 4.2 | 26.9 | 1.1 | 11.1 | 13.1 | 3.3 | 0.7 |
| Float 3 | 3.75 | 2.2 | 23.4 | 1.9 | 18.7 | 6.0 | 3.0 | 0.6 |
| Sink | 3.75 | 75.2 | 2.5 | 1.5 | 85.1 | 21.8 | 80.6 | 95.8 |
| Feed | 0 | 100.0 | 8.6 | 1.4 | 66.8 | 100.0 | 100.0 | 100.0 |

Analysis of the data shows that total recovery of the phosphate values in the overflow was over 78 percent, with a concentrate grade of over 27 percent $P_2O_5$: over 80 percent of the MgO and nearly 96 percent of the $SiO_2$ were simultaneously removed in the sink fraction. Of the phosphate recovered, 92 percent floated within the first 30 seconds. Results shown in Table V supra demonstrate that the grade of the concentrate decreases with increased length of flotation time, with mechanical carryover of nonfloatable dolomite and silica possibly responsible for their relatively high concentrations in the last float fraction collected during the final 3.25 minutes of flotation. Although the grade of the combined concentrate is lower than that of Example IV supra, there is an appreciable increase in recovery of phosphate values, even after the more strictly comparable flotation time of 30 seconds.

EXAMPLE VI

As a primary purpose of conducting the tests reflected in this example, further use was made of the sulfidization solution previously used in Example IV supra to demonstrate another aspect of our invention. After decantation following the sulfidization treatment in the penultimate example, i.e., Example IV supra, the residual sulfidizing liquor contained a mixed suspension of colloidal copper and zinc sulfide which had precipitated during the previous sulfidization step, either directly from solution or onto the surface of the treated minerals, but without subsequent adherence to the mineral surfaces.

To determine the effectiveness of this heavy metal sulfide colloidal suspension as a mineral sulfidization agent, 1.5 grams of phosphate ore similar to that used in Example I supra was treated for five minutes with 140 ml of the aforementioned colloidal sulfide suspension. The colloid was relatively freshly prepared, having only formed about three hours previously during execution of Example IV supra. No attempt was made to adjust the pH of the sulfidizing liquor. After washing the treated ore with two 25-ml rinses of water, the ore was conditioned in the small flotation cell used in Example I supra for about three minutes with 115 ml of a solution containing 0.16 gram/liter of potassium amyl xanthate and with pH 8.5. After subsequent flotation, as in Example I above, about 20 percent of the apatite mineral in the feed was recovered in the float with very little dolomite and quartz present as impurities in the float. Although recovery of phosphate values was not high in the instant example, flotation selectivity was good, with little contamination of those phosphate values recovered in the overflow product.

This example demonstrates a different mode of selective surface sulfidization for the apatite mineral than that represented by the previous examples illustrating our invention. In previous examples, the heavy metal (either Cu alone or Cu with Zn) in the form of a solution of a suitable soluble salt was preferentially adsorbed onto the phosphate mineral surface as a mordant, with subsequent reaction with soluble sulfide to directly precipitate a metal sulfide film at the phosphate mineral surface in a two-step surface sulfidization process. However, in the present example representing still another embodiment of our invention, the metal sulfide was instead initially precipitated directly from solution as a colloid, with the colloidal metal sulfide itself being subsequently and preferentially adsorbed on the surface of the phosphate mineral in a single step.

As colloidal heavy metal sulfide was formed by solution precipitation to some degree in the previous examples given, this second one-step mechanism of heavy metal sulfide adsorption on the phosphate mineral surface as a colloidal film may coexist with the aforementioned two-step mechanism of metal sulfide formation in situ on the phosphate mineral surface and may be of significance when the two-step sulfidization procedure used in the previous examples is practiced.

In an identical test made three days later with another sample of the same sulfidization liquor, negligible mineral flotation occurred. This demonstrates the desirability of using a freshly prepared sulfide colloid rather than an aged, at least partially coagulated, colloidal sulfide suspension in this embodiment of the present invention.

EXAMPLE VII

This example also demonstrates use of the single-stage sulfidization pretreatment, but in contrast to that given by Example VI supra, the flotation feed rock in this instance is treated by a sulfidizing medium comprising an aqueous solution containing copper and sulfide ions, with contact between the flotation feed and sulfidization medium initiated before significant nucleation and precipitation of a copper containing sulfide had occured from the bulk solution phase. A phosphate ore from the southern extension of the central Florida deposit, originating from a different mine than that used in previous examples assaying 9.2 percent $P_2O_5$, 1.8 percent MgO, 65 percent $SiO_2$, 1.1 percent $Fe_2O_3$, and 0.7 percent $Al_2O_3$ and with all but 3.5 percent by weight passing 28-mesh (600 μm), was used in this example. The ore was deslimed by scrubbing for 10 minutes at a pulp density of 55 percent solids by weight and wet screened on a 100-mesh screen with subsequent storage of the prepared feed in a moist condition. This desliming procedure yielded a flotation feed material which analyzed as 9.5 percent $P_2O_5$, 1.47 percent MgO, and 63 percent $SiO_2$.

An 8-gram (dry basis) sample of this prepared ore was then contacted with 350 ml of an aqueous solution containing 0.001M $CuSO_4$, 0.00025M $Na_2S_2O_3$, and 0.0005M $Na_2S$. This treatment solution was prepared by taking 250 ml of 0.0014M $CuSO_4$ solution, adjusting the pH thereof to 3.5, and then adding thereto 100 ml of a solution containing 0.00175M $Na_2S$ and 0.000875M $Na_2S_2O_3$. After treating the flotation feed for 15 minutes (final pH=6.4) in this sulfidizing solution, said sulfidizing solution was decanted and the treated feed briefly washed twice with 150 ml of water. In the next step, the treated feed was conditioned for about 5 minutes in 100 ml of an aqueous solution (pH about 8.5) containing potassium amyl xanthate ($8\times10^{-4}$M) as collector and a little pine oil as frother, and then floated with air for one minute in a small glass flotation cell. This cell was designed to simulate a scaled-down Denver flotation cell. The float and sink fractions were filtered, oven dried, and analyzed. Flotation results are presented in Table VI below.

TABLE VI

| | | Flotation Material Balance | | | | | |
|---|---|---|---|---|---|---|---|
| | | Composition, wt % | | | Distribution, wt % | | |
| Product | Wt % | $P_2O_5$ | MgO | $SiO_2$ | $P_2O_5$ | MgO | $SiO_2$ |
| Float | 27.1 | 29.0 | 0.85 | 12.4 | 82.4 | 15.7 | 5.3 |
| Sink | 72.9 | 2.3 | 1.70 | 82.7 | 17.6 | 84.3 | 94.7 |
| Feed | 100.0 | 9.5 | 1.47 | 62.9 | 100.0 | 100.0 | 100.0 |

Despite the apparent mechanical transfer of some fine silica particles to the float fraction due to inadequacies of the cell design exacerbated by use of a frother, this example demonstrates the excellent selectivity whereby another embodiment of our new and novel invention provides for effective separation of the dolomite from the phosphate mineral.

In this example, the hydrophobicity of the treated phosphate mineral particles was particularly noticeable prior to flotation. Thus, during the conditioning step with the xanthate solution, the said phosphate particles were markedly agglomerating and clumping together, with a few gas bubbles present apparently acting as nuclei; but the adjacent dolomite and silica particles in contrast showed no such behavior, remaining completely wetted by the solution and completely free-flowing.

EXAMPLE VIII

This example demonstrates the possibility of at least partially substituting for the xanthate collectors used for flotation conditioning in previous examples the surfactant oleic acid, a major component of most tall oils. Phosphate rock samples tested in this example are similar in composition and preparation to that used in Example VII supra.

The feed rock (8 g dry basis) was contacted for approximately 6 minutes with 350 ml of an aqueous solution (pH adjusted to 4.0) contaning 0.0015M $CuSO_4$.

After decanting this solution, the flotation feed was then treated for about 2 minutes with a 0.0004M $Na_2S$ solution (pH 8.0). After decanting the sulfide solution and briefly washing the feed material with 50 ml of water, the treated solids were conditioned (pH 8.5) for 5 minutes in 100 ml of a collector solution having the composition given in Table VII infra. Oleic acid was used in the form of the sodium salt. After conditioning, the slurry was floated for about one minute with air to recover the phosphate values, leaving both carbonate and silica impurities in the sink. No supplemental frothing reagent was added for the flotation step. Conditioning and flotation steps were performed in the flotation cell used in Example VII. Float and sink fractions were filtered, oven dried, and analyzed. Three tests were made under identical conditions with the exception that the collector composition was varied. Results are presented in Table VII below.

TABLE VII

| | | Analyses for Float Fractions | | | | | | |
|---|---|---|---|---|---|---|---|---|
| | Collector composition | Float | Composition, wt % | | | Recovery, % | | |
| Test | (Mole/liter) | wt % | $P_2O_5$ | MgO | $SiO_2$ | $P_2O_5$ | MgO | $SiO_2$ |
| A | K amyl xanthate ($4 \times 10^{-4}$ M) | 0.3 | — | — | — | — | — | — |
| B | K amyl xanthate ($2 \times 10^{-4}$ M) + Na oleate ($2.5 \times 10^{-5}$ M) | 21.3 | 30.1 | 0.8 | 5.1 | 70.0 | 12.5 | 1.6 |
| C | Na oleate ($5 \times 10^{-5}$ M) | 19.9 | 31.1 | 1.2 | 5.8 | 65.9 | 14.7 | 1.7 |

In this example as illustrated in Table VII above, it may be seen that under conditions giving very little float using xanthate as sole collector (Test A), partial substitution of the xanthate with a small amount of sodium oleate (Test B) is beneficial, giving as a float fraction a phosphate concentrate acceptable in terms of both recovery and grade. Total replacement of the xanthate in Test C with sodium oleate, at double the concentration used in Test B, also provides recovery of phosphate in the float fraction, although more dolomite was also floated as indicated by the higher MgO analysis for the float fraction. In Tests B and C, and in other examples given supra, further upgrading of the phosphate float may be possible, with little attendant loss in phosphate recovery, by performing a cleaner flotation step on said material, whereby the rougher float containing the phosphate values is immediately refloated in water, under conditions beneficially requiring no further use of additives or pH adjustments.

It must be emphasized here that in our initial examples of the scaled-up flotation process using the Denver laboratory flotation cell, we have not endeavored to optimize the process conditions of our invention, but have kept the operations of the new process as simple as possible to more clearly illustrate the basic concepts underlying said invention. It is fully expected that further improvements in the process of our new and novel invention pertaining to recovery and grade of the phosphate values and minimization of reagent usage will be achieved by optimization of process parameters in both sulfidization treatment and in the conditioning and flotation steps of the invention.

It will be recognized by those skilled in the art that modifications in the single flotation stage of our process including, but not limited to, decreasing the collector concentration; increasing the pulp density during conditioning; adding fuel oil as a supplementary collector; using additional flotation reagents described as foamers, activators and depressants; and refloating the overflow containing the phosphate values in a cleaner float may singly or in some combination provide a phosphate product of both grade and yield higher than that obtained in our initial examples and comparable or superior to that achieved by those costly and more complex multistage flotation schemes proposed in the prior art for separating the phosphate values from both alkaline earth metal carbonate and siliceous gangue. It will be further recognized by those skilled in the art that many parameters are available to optimize conditions for the sulfidization step without altering the basic concepts of our invention. Such parameters include, but are not necessarily limited to, the nature and quantity of the metal mordant forming the sulfide coating, the mordant to sulfide ratio, the sulfide concentration in the sulfidization solution, the ratio of sulfide to feed rock, the sulfidization pH, and treatment times and temperatures.

INVENTION PARAMETERS

After sifting and winnowing through the data supra, as well as other results and operations of our new, novel, and improved method for beneficiating phosphate ore, we now present the principal operating parameters and variables for the flotation separation comprising the present invention as shown below, it being understood that other variables, as considered and discussed supra may alone, or in various combinations be additional viable operation considerations and parameters thereof.

| Sulfidization Pretreatment Conditions | Operating Range | Preferred Range |
|---|---|---|
| Cu (kg/ton of feed) | 0.05–1.5 | 0.05–0.3 |
| Zn/Cu (mole ratio), if applicable | 0.1–0.9 | 0.2–0.6 |
| S (kg/ton of feed) | 0.05–1 | 0.05–0.3 |
| Two-stage | | |
| pH (Cu solution) | 3–7 | 3.5–6 |
| Treatment time (Cu solution-min) | 0.5–20 | 1.0–10 |
| pH (S solution) | 4–10 | 7–9 |
| Treatment time (S solution-min) | 0.5–10 | 2–5 |
| One-Stage (solution and/or colloidal suspension) | | |
| (Cu + Zn)/S (mole ratio) | 0.25–10 | 0.5–3 |
| pH | 3–7 | 3.5–6 |
| Treatment time (min) | 1–30 | 4–16 |
| Flotation Conditions | | |
| Feed size (mm) | 0.035–1 | 0.1–0.6 |
| Flotation collector for creating or enhancing hydrophobic surfaces on phosphate mineral (kg/ton of feed) | 0.2–2 | 0.5–1.2 |
| Conditioning pulp density (% solids by weight) | 15–74 | 25–70 |
| Conditioning pH | 3–10 | 7–9.5 |
| Conditioning time (min) | 1–10 | 2–5 |
| Conditioning impeller tip speed (cm/sec) | 90–220 | 110–180 |

| Reagent Specification | Operating | Preferred |
|---|---|---|
| Anion for Cu treatment reagents (and Zn if applicable) | sulfate, nitrate | sulfate |
| Cation for sulfidization reagents | sodium, potassium, ammonium | sodium |
| Collector for floating | thiocarbonates including | (same as |

-continued

| | | |
|---|---|---|
| phosphate mineral | xanthates, dithiophosphates, thiocarbamates, thiono-carbamate esters, mercaptans, and their derivatives. | under Operating) |
| Substitute or supplementary flotation collector (if applicable) | organic sulfonates, organic sulfates, fatty acids, sulfonated fatty acids, tall oils | tall oils |

While we have shown and described particular embodiments of our invention, modifications and variations thereof will, of course, occur to those skilled in the art. We wish it to be understood, therefore, that the appended claims are intended to cover such modifications and variations which are within the true scope and spirit of our invention.

What we claim as new and desire to secure by Letters Patent of the United States is:

1. An improved single stage flotation process eminently suitable for beneficiating phosphate ores containing, as impurities, silica and alkaline earth metal carbonates, which process comprises the steps of:

(a) comminutating and classifying, to predetermined size, a feed of phosphate ore containing, as impurities, silica and alkaline earth metal carbonates;

(b) conditioning the resulting, sized, phosphate ore particulate feed by subjecting same to sulfidization treatment whereby the surfaces of the minerals, comprising the phosphate values therein, are selectively sulfidized with adsorbed water insoluble metal sulfide, the metal constituent of said sulfide being substantially copper;

(c) conditioning the resulting, sulfidized, sized, phosphate ore particulate feed by contacting same with sulfide mineral collecting reagent;

(d) introducing the resulting, conditioned, particulate feed into single-stage froth flotation means, wherein are maintained oxidizing conditions, and effecting flotation thereof;

(e) recovering as product from said single stage froth flotaton means, in the overflow therefrom, a substantial portion of the phosphate values of the feed thereto; and (f) simultaneously removing as byproduct from said single stage froth flotation means, in the underflow therefrom, both the resulting separated silica and the separated carbonate gangue minerals.

2. The process of claim 1 wherein the formation conditioning step in step (c) thereof comprises contacting the sulfidized sized phosphate ore particulate feed with a mineral collecting reagent selected from the group consisting of organic sulfonates, organic sulfates, fatty acids, sulfonated fatty acids, and tall oils; reagents now commonly regarded chiefly as flotation collectors in nonsulfide rather than sulfide mineral flotation technology admixed with, as a supplement to or substituting for, a mineral collecting reagent selected from the class of thio-organic compounds commonly used in sulfide mineral flotation technology and selected from the group, and their derivatives, consisting of thiocarbonates, dithiophosphates, thiocarbamates, thionocarbamate esters, mercaptans, and mixtures thereof.

3. The process of claim 1 wherein the sulfide mineral collecting reagent in step (c) thereof is selected from the group and the derivatives, consisting of thiocarbonates, dithiophosphates, thiocarbamates, thionocarbamate esters, mercaptans, and mixtures therof.

4. The process of claim 1 wherein the sulfide mineral collecting reagent in step (c) thereof is an alkyl xanthate.

5. The process of claim 4 wherein said alkaline earth metal carbonate impurites comprise dolomite.

6. The process of claim 1 wherein the sulfidization conditioning treatment in step (b) thereof comprises the steps of (aa) contacting the resulting sized phosphate ore particulate feed with an aqueous solution containing soluble salts of at least one species of metal ion, at least one of said metal ion specie being copper and said specie effecting the in situ formation of highly water insoluble sulfide in step (bb) infra and said metal ion specie, which latter effects said in situ formation of water insoluble sulfide, being preferentially adsorbed on the phosphate mineral surfaces as a mordant, and (bb) contacting the particulate feed resulting from the treatment in step (aa) supra with an aqueous solution of a water soluble alkali sulfide and/or hydrosulfide selected from the group consisting of sodium, potassium, ammonium, and mixtures thereof.

7. The process of claim 6 wherein the sulfide mineral collecting reagent is selected from the group, and their derivatives, consisting of thiocarbonates, dithiophosphates, thiocarbamates, thionocarbamate esters, mercaptans, and mixtures thereof.

8. The process of claim 6 wherein said alkaline earth metal carbonate impurities comprise dolomite.

9. The process of claim 6 wherein the sulfide mineral collecting reagent is an alkyl xanthate.

10. The process of claim 6 wherein the metal ion of zinc is substituted for up to as much as fifty percent, by weight, for the metal ion of copper.

11. The process of claim 10 wherein the sulfide mineral collecting reagent is an alkyl xanthate.

12. The process of claim 10 wherein said alkaline earth metal carbonate impurities comprise dolomite.

13. The process of claim 10 wherein the sulfide mineral collecting reagent is selected from the group, and their derivatives, consisting of thiocarbonates, dithiophosphates, thiocarbamates, thionocarbamate esters, mercaptans, and mixtures thereof.

14. The process of claim 1 wherein the sulfidization conditioning treatment in step (b) thereof comprises the step of contacting the resulting, sized, phosphate ore particulate feed with an aqueous dispersion of a copper containing sulfide in the form of a, relatively freshly prepared, colloidal suspension, therby effecting the preferential adsorption of the copper sulfide colloid onto the surfaces of the minerals comprising the phosphate values therein.

15. The process of claim 14 wherein said alkaline earth metal carbonate impurities comprise dolomite.

16. The process of claim 14 wherein the sulfide mineral collecting reagent is selected from the group, and their derivatives, consisting of thiocarbonates, dithiophosphates, thiocarbamates, thionocarbamate esters, mercaptans, and mixtures thereof.

17. The process of claim 14 wherein said aqueous dispersion contains, in addition to said copper containing sulfide, a zinc containing sulfide to thereby effect adsorption of both copper and zinc sulfide colloids onto the surfaces of the minerals comprising the phosphate values therein.

18. The process of claim 12 wherein said alkaline earth metal carbonate impurities comprise dolomite.

19. The process of claim 12 wherein the sulfide mineral collecting reagent is selected from the group, and their derivatives, consisting of thiocarbonates, dithiophosphates, thiocarbamates, thionocarbamate esters, mercaptans, and mixtures thereof.

20. The process of claim 1 wherein the sulfidization conditioning treatment in step (b) thereof comprises the step of contacting the resulting sized phosphate ore particulate feed with an aqueous solution containing copper and sulfide ionic species prior to significant nucleation and precipitation of a copper containing sulfide from the bulk solution phase, thereby affecting the preferential adsorption of a water insoluble copper containing sulfide onto the surfaces of the minerals comprising the phosphate values therein.

21. The process of claim 20 wherein the metal ion of zinc is substituted for up to as much as fifty percent, by weight, for the metal ion of copper.

* * * * *